US008662095B2

(12) United States Patent
Leavitt

(10) Patent No.: US 8,662,095 B2
(45) Date of Patent: Mar. 4, 2014

(54) BOOTH WITH INFLATABLE CANOPY

(76) Inventor: Chris P. Leavitt, Chandler, AZ (US)

( * ) Notice: Subject to any disclaimer, the term of this patent is extended or adjusted under 35 U.S.C. 154(b) by 286 days.

(21) Appl. No.: 13/087,149

(22) Filed: Apr. 14, 2011

(65) Prior Publication Data

US 2012/0260959 A1 Oct. 18, 2012

(51) Int. Cl.

| | |
|---|---|
| ***E04H 15/54*** | (2006.01) |
| ***E04H 15/26*** | (2006.01) |
| ***E04H 15/34*** | (2006.01) |
| ***E04H 15/64*** | (2006.01) |

(52) U.S. Cl.
USPC ..... 135/115; 135/99; 135/121; 135/119

(58) Field of Classification Search
USPC ..... 135/99, 121, 115; 52/2.18, 2.19, 2.11
See application file for complete search history.

(56) References Cited

U.S. PATENT DOCUMENTS

| | | | | | |
|---|---|---|---|---|---|
| 2,535,618 | A * | 12/1950 | Williams | 135/158 |
| 2,863,467 | A * | 12/1958 | Hearell | 52/2.17 |
| 3,338,000 | A * | 8/1967 | Ostrander et al. | 52/2.17 |
| 4,452,017 | A * | 6/1984 | Tang et al. | 52/2.17 |
| 4,932,169 | A * | 6/1990 | Charbonneau | 52/2.18 |
| 5,009,041 | A * | 4/1991 | Fly | 52/2.19 |
| 5,259,077 | A * | 11/1993 | Hager et al. | 4/498 |
| 6,367,495 | B1 * | 4/2002 | Powell et al. | 135/122 |
| 2002/0170588 | A1 * | 11/2002 | Seo | 135/90 |
| 2003/0034061 | A1 * | 2/2003 | Warner | 135/144 |

* cited by examiner

*Primary Examiner* — David Dunn
*Assistant Examiner* — Danielle Jackson
(74) *Attorney, Agent, or Firm* — The von Hellens Law Firm, Ltd.

(57) ABSTRACT

A framework of uprights interconnected by rods defines a rectangular area to support an inflatable canopy. The canopy includes an interior membrane and an exterior membrane to define an envelope. A skirt depending from the canopy is secured to the framework to retain the canopy in place. A framework mounted air pump provides a flow of air to inflate the envelope. A framework supported pole engages and supports at least the interior membrane.

16 Claims, 5 Drawing Sheets

BOOTH WITH INFLATABLE CANOPY

BACKGROUND OF THE INVENTION

1. Field of the Invention

The present invention relates to exhibition booths and, more particularly, to inflatable canvas tops for booths.

2. Description of Related Prior Art

State fairs, outdoor exhibitions, sporting events and the like, are usually populated by exhibitors exhibiting their wares for demonstration and/or sales purposes. Particularly at state fairs, such booths are used for games of skill and the like. Because such uses of the booths are temporary, ease of erection and dismantling is a requisite. Potential inclement weather and/or protection from the sun dictate that the framework includes supported elements for a cover.

Generally, the framework defines a width and depth equivalent to a square or rectangle as a function of the size of the booth. Usually four uprights are interconnected by rods at the top to provide stability and rigidity. To support a cover, orthogonally aligned diagonal cross-members interconnect opposing top corners of the framework and support at the center a vertical post. The cover may be pyramidal shaped supported at the top by the post extending upwardly from the cross-members extending between the uprights. The attachment of the cover to the rods may be via straps secured about the rods by snaps or various configurations of hook-and-loop fastening members, such as the type sold under the trademark VELCRO® (hook and loop fastener).

Except for coloring or graphic designs on the cover, there is little distinction between the covers of adjacent booths. Thus, the covers are seldom memorable to visitors at state fairs, exhibitions, or sporting events.

SUMMARY OF THE INVENTION

An inflatable canopy for mounting on a conventional framework for a booth includes an interior membrane and an exterior membrane. The interior membrane is generally of a pyramidal shape. However, the exterior membrane may be configured to replicate a unique configuration that is highly memorable and may be reflective of the purpose or function of the booth. A post extending upwardly from diagonal members secured to the framework supports the interior membrane and may also support the exterior membrane. The inflatable canopy includes a skirt detachably attached to rods extending between uprights of the framework to provide stability for the inflatable canopy and yet afford ease of mounting and demounting the canopy. A source of air under pressure, such as a conventional air pump, inflates the canopy and maintains it inflated during the period of use.

It is therefore a primary object of the present invention to provide a uniquely shaped canopy mountable on a framework for a booth.

Another object of the present invention is to provide an inflatable canopy for a booth used outdoors.

Yet another object of the present invention is to provide an easily mountable and demountable inflatable canopy for the framework of a booth.

Still another object of the present invention is to provide an inflatable canopy for a booth to insulate an interior membrane of the canopy from solar radiation.

A further object of the present invention is to provide a framework for a booth having support elements for supporting the interior and exterior membranes of an inflatable canopy.

A yet further object of the present invention is to provide an inflatable canopy for use with a conventional framework for a booth.

A still further object of the present invention is to provide an easily erectable and dismantleable inflatable canopy having a uniquely configured exterior membrane for use with the framework of a booth.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Vendors at state fairs, exhibitions and promotions generally display their wares or advertise their services under framework supported canopies. Additionally, and more particularly at state fairs, various entities provide games of skill under framework supported canopies. Generally, the canopies are pyramid-like configurations supported upon four posts or uprights. The footprint for the framework may be square or rectangular depending upon the size and configuration sought to provide sufficient space for the activity undertaken. The covers are generally of canvas or plastic supported upon a center post to provide a pyramidal configuration. They are detachably attached to the framework to facilitate erection and dismantling. Additionally, the framework is of the knock-down type to facilitate erection and dismantling. Because the covers are generally of a single pyramidal configuration, there is little distinction between booths and the only distinguishing features that can be incorporated are either colors, patterns, or graphics.

Figure 1:
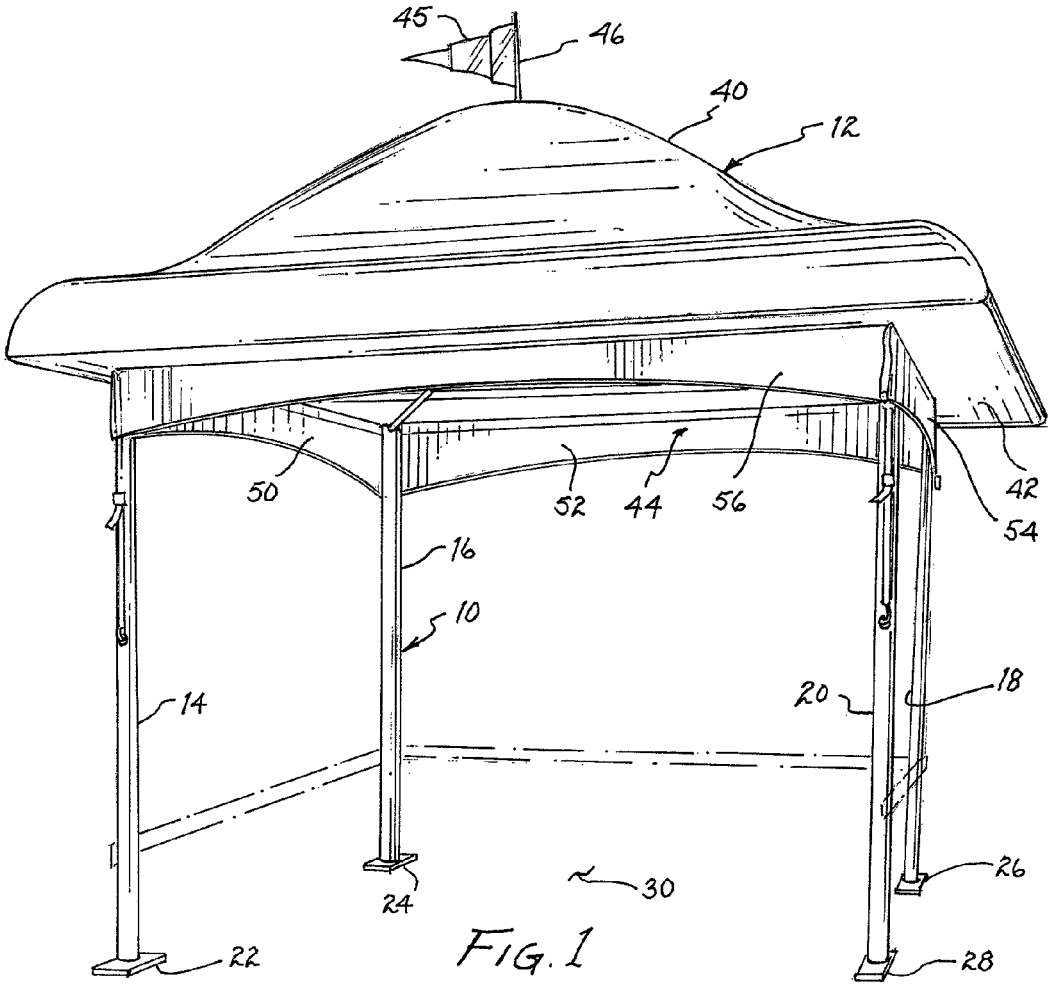
FIG. 1 illustrates an inflatable canopy supported upon the framework for a booth.

Referring to FIG. 1, there is illustrated a framework 10 supporting a canopy 12. The framework may include four stanchions or uprights 14, 16, 18 and 20. A plate 22, 24, 26, 28 may be disposed at the lower end of each of uprights 14, 16, 18 and 20, respectively, to prevent the uprights from sinking into the ground or surface 30. Canopy 12 includes an exterior membrane 40 that may be pyramidal shaped, as illustrated. Alternatively, it can be of any configuration commensurate with the desires of a user. As illustrated, exterior membrane 40 may extend laterally in one or more directions to provide an overhang extending laterally from two or more pairs of adjacent uprights. A skirt 44 extends about the perimeter defined by uprights 14, 16, 18 and 20 to secure the canopy to framework 10. As illustrated, a pennant 45 may be attached to a pole 46 extending upwardly from the exterior membrane.

Figure 2:
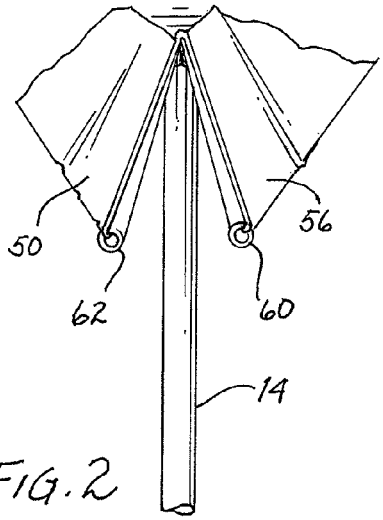
FIG. 2 is a detail view of the corner attachment of a skirt extending from the inflatable canopy.
Figure 3:
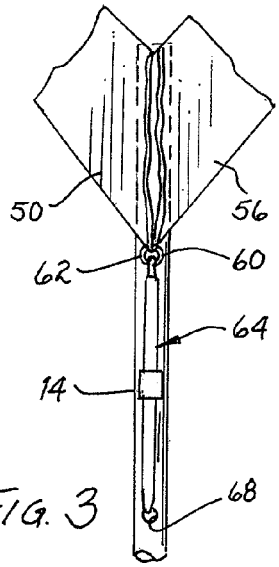
FIG. 3 illustrates a post mounted adjustable strap for drawing down the corner of the skirt.
Figure 4:
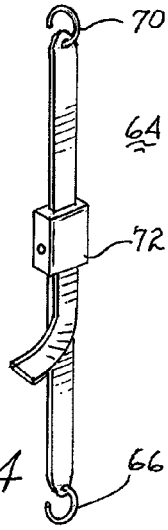
FIG. 4 is a detail view of the strap shown in FIG. 3.

Referring jointly to FIGS. 2, 3 and 4, apparatus for securing skirt 44 to each of the uprights will be described. The skirt includes four sections 50, 52, 54 and 56 extending downwardly from canopy 12. For illustrative purposes, only upright 14 and the adjacent skirt sections will be described with respect to FIGS. 2, 3 and 4. It is to be understood that similar structure is present at each of the remaining uprights. A ring 60 is attached to a corner of section 56; a similar ring 62 is attached to the corner of section 50. An adjustable strap 64 may include a hook 66 for engagement with an aperture 68 in upright 14 and a hook 70 for engagement with each of rings 60, 62. The strap includes an adjustment mechanism 72 to draw rings 60, 62 downwardly and thereby secure sections 50, 56 of skirt 44 to upright 14. A similar strap engages the corners of the pair of sections attendant each of the remaining uprights to secure canopy 12 and prevent disengagement of the canopy from framework 10.

Figure 5:
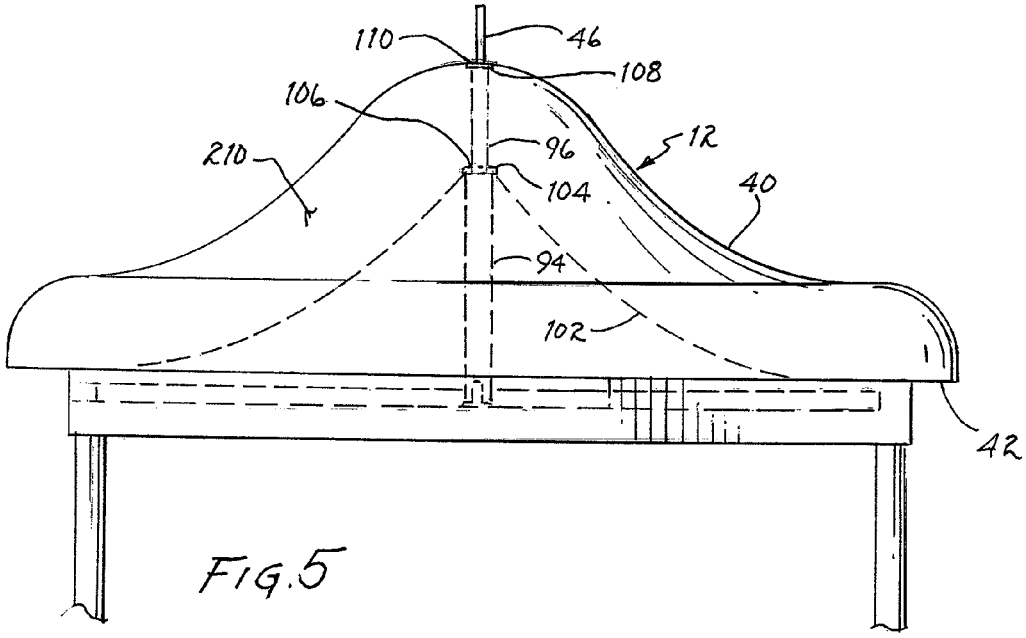
FIG. 5 is a side view of the inflatable canopy mounted on a framework and depicting the interior mechanical support and the interior membrane of the inflatable canopy.
Figure 6:
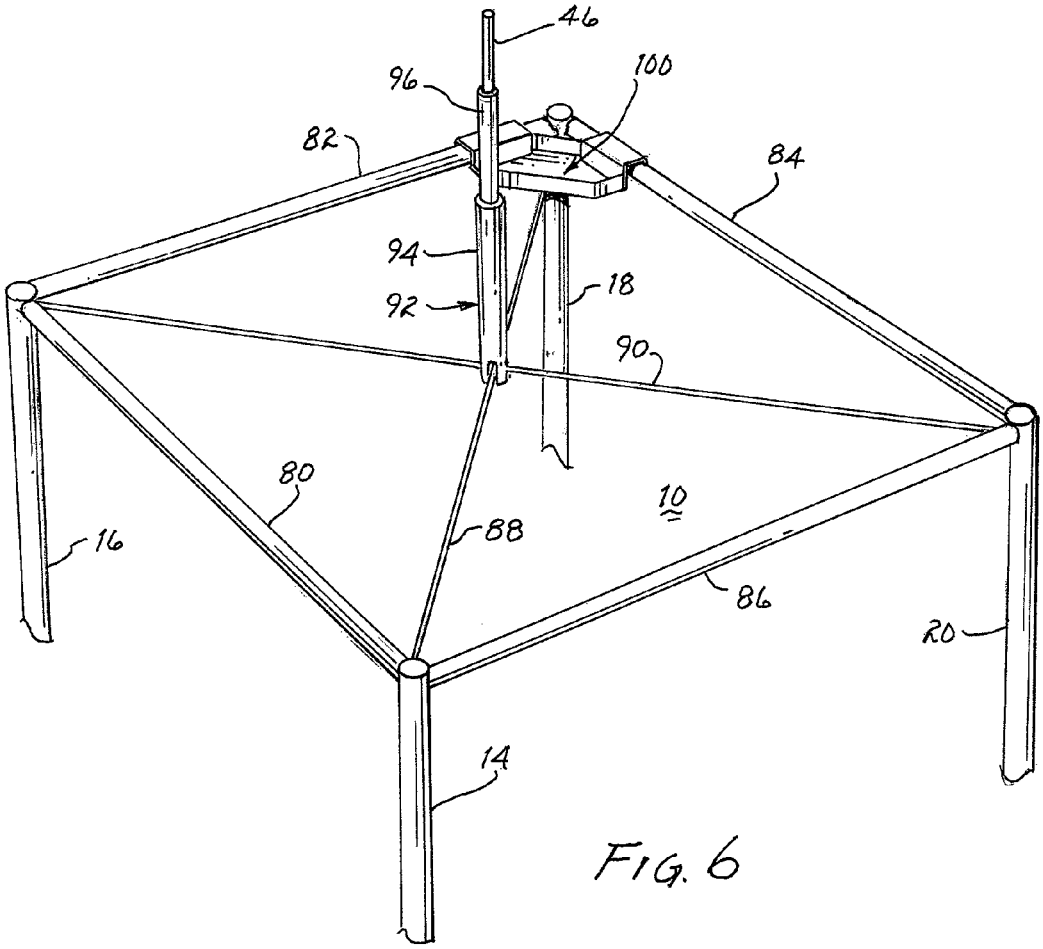
FIG. 6 illustrates the basic components of the framework for supporting the inflatable canopy.

Referring jointly to FIGS. 5 and 6, further details attendant framework 10 and its support for canopy 12 will be described. The upper ends of pairs of uprights 14 and 16, 16 and 18, 18 and 20, 20 and 14, are interconnected by rods 80, 82, 84, and 86, respectively. To render the frame rigid, diagonal cables 88 and 90 interconnect the upper ends of uprights 14 and 18, 16 and 20, respectively. The tension exerted by these cables retains the box-like configuration of framework 10, whether this configuration is square or rectangular. To support at least the interior membrane of canopy 12, a post 92 is supported at the intersection of cables 88, 90 by inserting the cables in respective pairs of orthogonal slots at the lower end of the post. The post includes a pipe 94, or the like, of a first diameter. A second pipe 96, or the like, extends upwardly from pipe 94 and is of lesser diameter, as illustrated. A pole 46 (see FIG. 1) may extend from pipe 96. It is to be understood that pipes 94, 96 and pole 46 may be hollow or solid and each is of reduced diameter with respect to the lower one. A platform 100 is secured to one of the corners of framework 10. As shown, the platform is supported by rods 82 and 84 and will be described in further detail below.

As particularly shown in FIG. 5, interior membrane 102 includes a ring 104 for penetrable engagement with pipe 96 and supported by end 106 of pipe 94. Exterior membrane 40 may include a ring 108 penetrated by pole 46 and supported by end 110 of pipe 96 if the exterior membrane is to receive support from the post.

Figure 7:
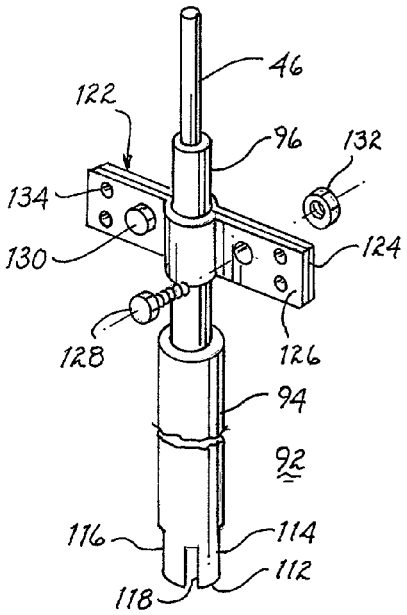
FIG. 7 illustrates a center post mounted bracket for supporting lights and other elements within the inflatable canopy.

FIG. 7 illustrates pipes 94, 96 and pole 46 forming post 92. As illustrated more clearly in this drawing, lower end 112 of pipe 94 includes two pairs of slots 114, 116 and 118, 120 (not shown), which pairs are diametrically opposed to engage cables 88, 90 (see FIG. 6). A bracket 122 may be mounted on pipe 96 to position the bracket within the space defined by exterior membrane 40 and interior membrane 102. The bracket includes two straps 124, 126 having semi-circular sections for jointly enveloping pipe 96. Bolts 128, 130 and their corresponding nuts 132 secure the straps to one another and capture pipe 96 therebetween. The bracket may include a plurality of apertures 134 or the like for suspending lights or other elements therefrom and within the envelope defined by exterior membrane 40 and interior membrane 102.

Figure 8:
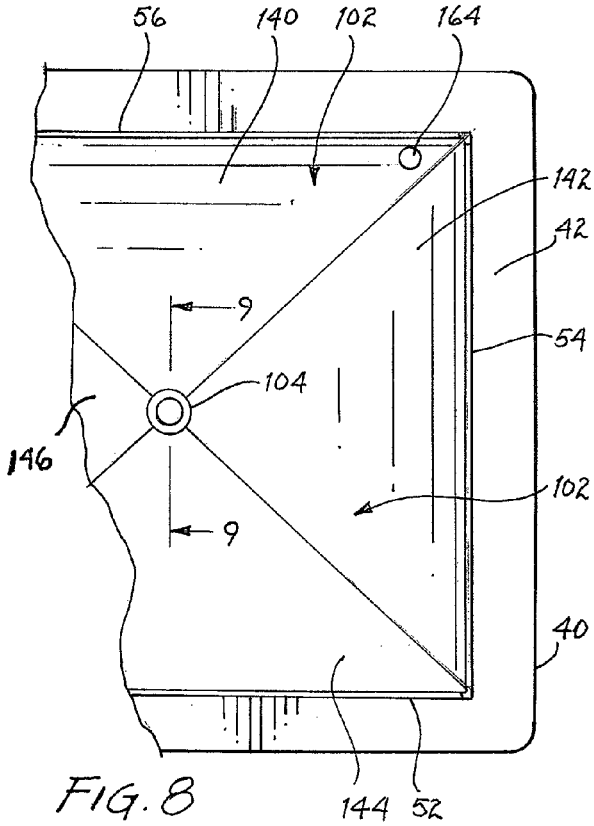
FIG. 8 is a view of the interior membrane.
Figure 9:
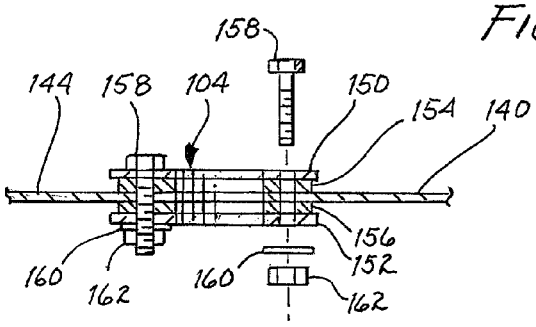
FIG. 9 is a cross-sectional view taken along lines 9-9, as shown in FIG. 8.
Figure 10:
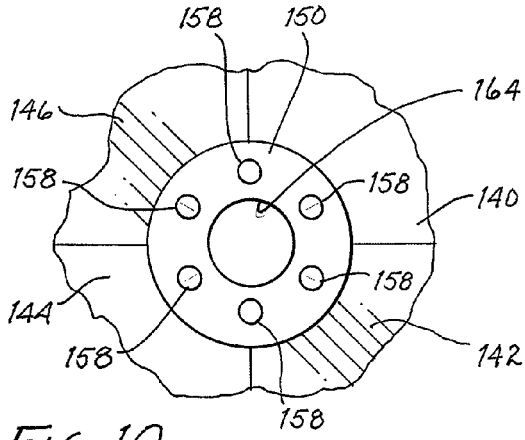
FIG. 10 illustrates a collar mounted on the interior membrane for engaging the central post.

Referring jointly to FIGS. 8, 9 and 10, further details attendant supporting interior membrane 102 on pipe 94 will be described. The configuration of interior membrane 102 may be essentially pyramidal and formed by four essentially triangular sheets 140, 142, 144 and 146. Ring 104 is attached at the apex of each of these sheets.

This ring, as shown in FIGS. 5 and 8, is formed by multiple elements, as will be described with respect to FIGS. 9 and 10. Ring 104 is formed by a first ring 150, which may be metal and a second ring 152, which also may be metal. An annular gasket 154 is disposed between first ring 150 and sheets 140, 142, 144 and 146. A further annular gasket 156 is disposed between second ring 152 and sheets 140, 142, 144 and 146. The tips at the apex of each of sheets 140, 142, 144 and 146 have been removed, which removal is essentially commensurate with the inner circumference of first and second rings 150, 152 to permit penetration therethrough of pipe 96. The rings, annular gaskets, and sheets are clamped together through bolts 158, washers 160, and nuts 162. As shown in FIG. 10, six nut and bolt combinations may be used to ensure that the ends of sheets 140, 142, 144 and 146 are firmly clamped therebetween and the gaskets ensure that there is minimal leakage of air intermediate the sheets and first ring 150.

As shown in FIG. 8, interior membrane 102 includes an opening 164 for injecting air under pressure into the space intermediate exterior membrane 40 and interior membrane 102.

Figure 11:
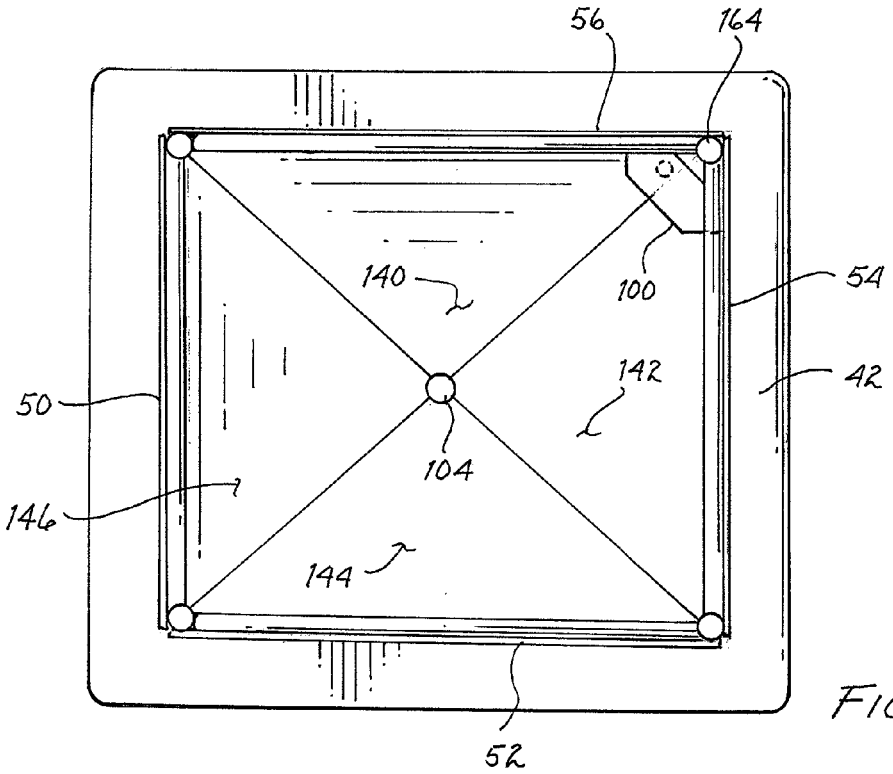
FIG. 11 is a view looking upwardly toward the inflatable canopy.

The air pump and related structure for inflating envelope 210 (see FIG. 5) defined by exterior membrane 40 and interior membrane 102 will be described with joint reference to FIGS. 11, 12, 13 and 14. FIG. 11 is a bottom view of the canopy similar to the view shown in FIG. 8 and corresponding elements will be identified by the same numerals.

Figure 12:
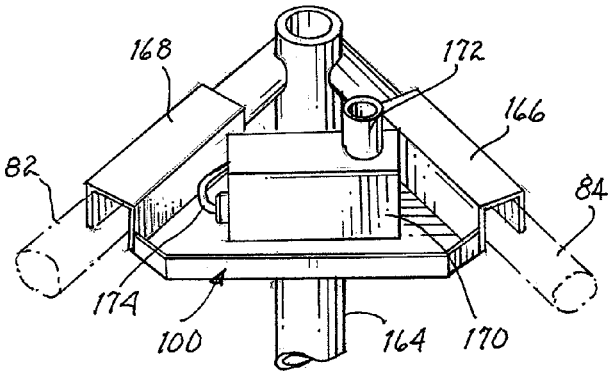
FIG. 12 illustrates a representative air pump and mounting therefor.
Figure 13:
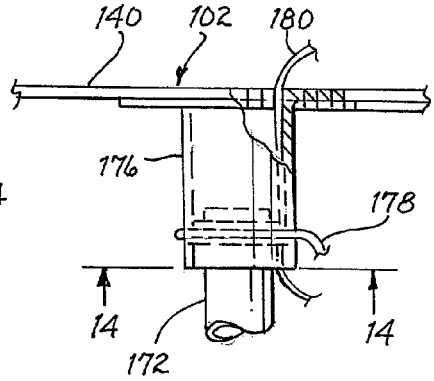
FIG. 13 illustrates the inlet for inflating the inflatable canopy.
Figure 14:
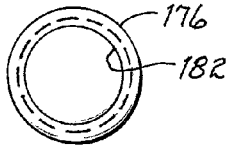
FIG. 14 is an end view taken along lines 14-14, as shown in FIG. 13.

Platform 100 will be described primarily with reference to FIGS. 12, 13 and 14. The platform includes channels 166, 168 for receiving and resting upon rods 84, 82, respectively, and provide the requisite support for the platform. An air pump 170 is mounted on the platform and includes an exhaust port 172. A source of electricity for the air pump is obtained through electrical conductor 174. The tube 176 (see also opening 164 in FIG. 8) is secured to sheet 140 of interior membrane 102 and extends downwardly to receive exhaust port 172. A tie strap 178 may be used to secure tube 176 with the exhaust port to prevent leakage therebetween. As shown in FIG. 13, an electrical conductor 180 may extend through tube 176 to provide electrical power to any lights or other elements supported from bracket 122 (see FIG. 7). FIG. 14 illustrates inlet 182 for receiving exhaust port 172.

Figure 15:
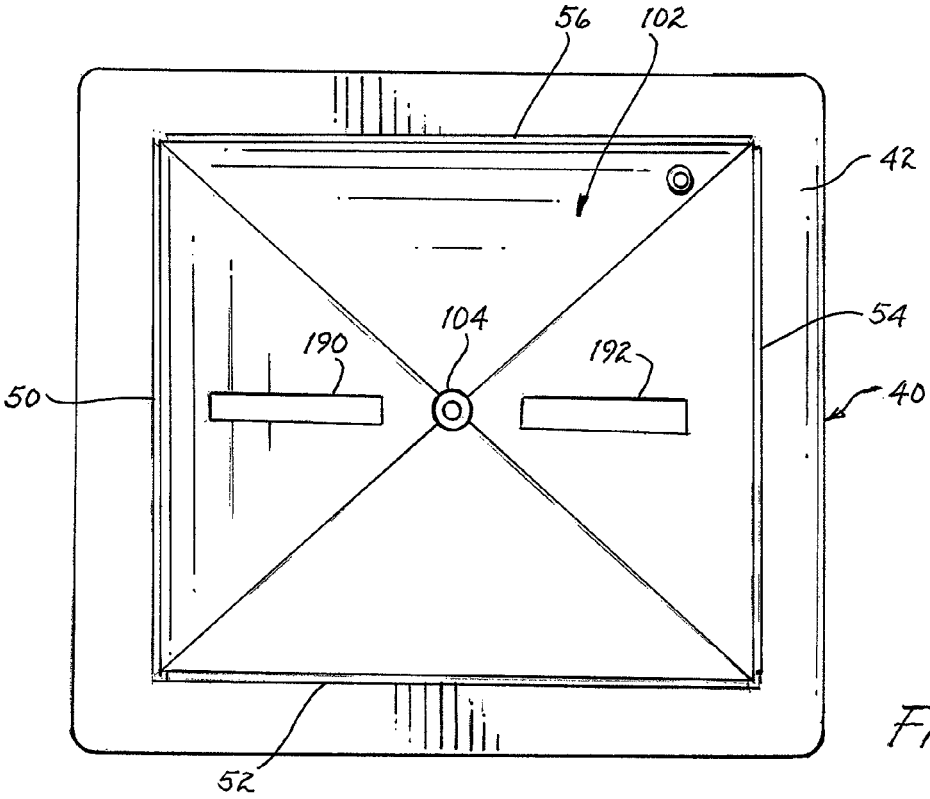
FIG. 15 is a view of the underside of the inflatable canopy showing optional access slots.
Figure 16:
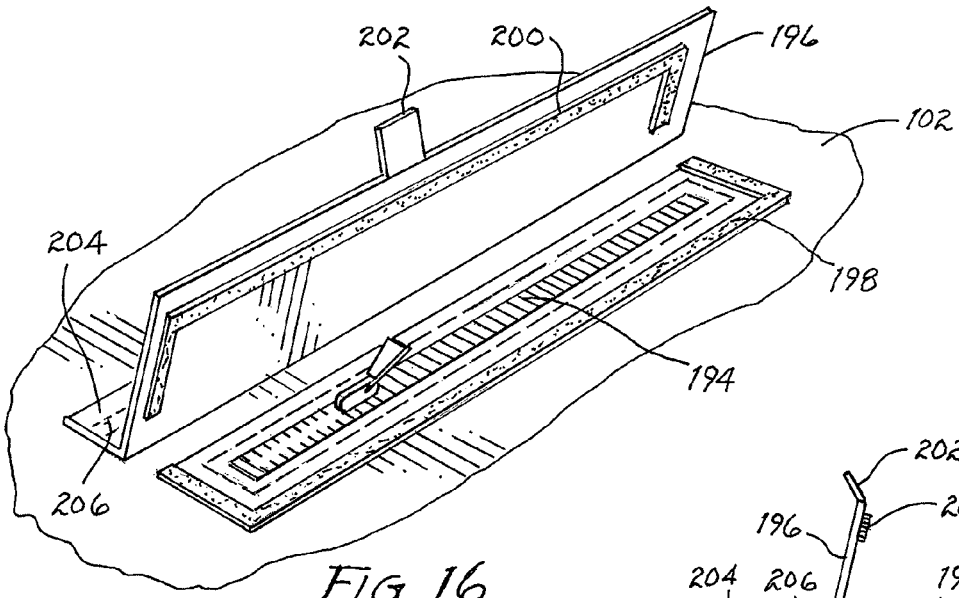
FIG. 16 illustrates a zipper closeable access slot and a cover therefor to reduce air leakage.
Figure 17:
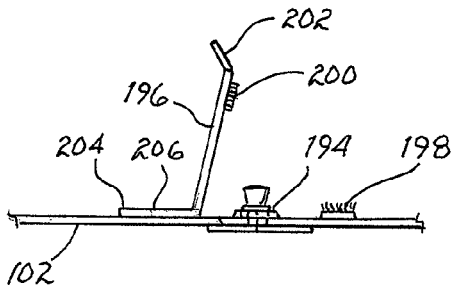
FIG. 17 is a side view of the slot, zipper and cover shown in FIG. 16.

Access to the envelope defined by exterior membrane 40 and interior membrane 102 may be provided by the zippered openings illustrated in FIGS. 15, 16 and 17. Again, common reference numerals will be used for elements previously described. Two access ports 190, 192 may be formed in interior membrane 102 to provide access to the interior and, more particularly, to any elements supported from bracket 122 within envelope 210. Each access port includes a zipper 194 to open and close the inlet. To provide a relatively leak-free access port, a hinged cover 196 is pivotally attached to interior membrane 102 and of a width and length to overlie zipper 194. Hook and loop fastening means, such as that sold under the trademark VELCRO® (hook and loop fastener), is employed to secure the cover to the interior membrane. For example, a strip 198 of loop fasteners may extend about the perimeter of zipper 194 and secured to interior membrane 102. Similarly, a strip 200 of hook fasteners may be attached to cover 196 to mate with the loop fasteners strip. Thereby, cover 196 is retained adjacent interior membrane 102 to minimize air leakage through zipper 194. To facilitate opening and closing of cover 196, a tab 202 may extend from cover 196. As shown, edge 204 of cover 196 may be sewn by threads 206 to interior membrane 102.

After erection of framework 10, canopy 12 is attached thereto and its interior membrane is supported at its center by post 92. This post provides support for interior membrane 102 separate from any support for exterior membrane 40 and produces envelope 210 defining a space (see FIG. 5). Depending on the configuration of exterior membrane 40 it may be self-supporting as a function of inflation of envelope 210 or may be configured to receive support from post 92 (as illustrated). Platform 100 and the associated air pump is mounted at one corner of framework 10. Tube 176 extending from interior membrane 102 is brought into sealed engagement with exhaust port 172. If lights or other elements are to be supported from bracket 122, they may be mounted by access through access ports 190 and/or 192. Electrical power for the lights or other elements is provided by electrical conductor 180 extending into envelope 210. Upon energizing air pump 170, the space within the envelope defined by exterior membrane 40 and interior membrane 102 will be pressurized to urge expansion of exterior membrane to its intended configuration.

As noted above, the configuration of the exterior membrane may be essentially pyramidal as illustrated and supported in part by post 92. However, the exterior membrane does not have to be supported by a post or other structure as the pressure provided by the air pump will inflate the canopy and it will retain its pre-determined shape. It can be of any shape, such as a beer can, a cartoon figure, lettering, etc. Additionally, the exterior membrane may be colored to depict a design or graphics may be formed thereon.

While framework 10 has been described as defining a rectangular/square footprint, it may be of any shape; such as circular/semi-circular/oblong, etc. The shape of canopy 12 would be commensurate with that of the framework.

It is therefore apparent that not only does the framework and supported canopy provide shade and an enclosure suitable for its location, whether it be a state fair, exhibition or simply a display but it is also capable of having a visual impact due to the size and shape of the canopy that may be selected. Hence, it will draw attention much more effectively than a conventional framework mounted canopy.

I claim:

1. A booth, said booth comprising in combination:

a) a framework, said framework including a plurality of uprights and a plurality of rods, one of said rods interconnecting an adjacent pair of said uprights, a first cable extending from a pair of said rods uprights and a second cable extending from another pair of said uprights in an intersecting relationship with said first cable;

b) an inflatable canopy, said canopy including an interior membrane and an exterior membrane for defining an envelope therebetween;

c) a pole supported at the intersection of said first and second cables, said pole having a first circumferential area for supporting said interior membrane and a second smaller circumferential area for supporting said exterior membrane;

d) a skirt extending from said envelope adapted to engage with said uprights to secure said canopy with said framework; and e) an air pump for inflating said envelope and for maintaining said envelope inflated.

2. The booth as set forth in claim 1 including a platform for supporting said air pump, said platform being adapted for receiving support from at least one of said rods and including an electrical conductor for providing electrical energy to said air pump.

3. The booth as set forth in claim 1 wherein said interior membrane includes a tube for receiving a flow of air from said air pump and into said envelope, said air pump including an exhaust port adapted to engage said tube.

4. The booth as set forth in claim 1 including a bracket mounted on said pole for supporting a selected element within said envelope and an access port disposed in said interior membrane to provide access to said bracket and any elements supported thereon.

5. The booth as set forth in claim 1 wherein said skirt includes a plurality of sections, each of said sections extending from one of said uprights to another of said uprights, a plurality of straps, one end of one strap of said plurality of straps being engageable with each upright of said plurality of uprights and the other end of each strap of said plurality of straps being engageable with the sections of said plurality of sections at the upright with which said strap is engaged.

6. A booth having a framework and a canopy supported by said framework, said booth comprising:

a) a plurality of uprights and a plurality of rods, each rod of said plurality of rods interconnecting adjacent ones of said plurality of uprights and at least a pair of cables interconnecting selected ones of said uprights and intersecting one another to provide rigidity to said framework;

b) an interior membrane and an exterior membrane defining an envelope of said canopy and a skirt extending from said canopy adapted for engagement with said plurality of uprights to secure said canopy with said framework;

c) a pole supported by said pair of cables at the intersection thereof to support said interior membrane at one location along said pole and said exterior membrane at another location along said pole; and d) an air pump for inflating said envelope.

7. The booth as set forth in claim 6 including a bracket attached to said pole for supporting selected elements within said envelope and an access port disposed in said interior membrane for providing access to said bracket.

8. The booth as set forth in claim 6 including a platform secured to at least one of said rods for supporting said air pump.

9. The booth as set forth in claim 8 including a tube extending from said interior membrane and an exhaust port extending from said air pump for engagement with said tube to convey air under pressure from said air pump into said envelope.

10. The booth as set forth in claim 6 wherein said pole extends through said exterior membrane for supporting a pennant.

11. A booth having a framework, the framework including four uprights having an upper end and a lower end, four rods, each of the rods interconnecting the upper ends of one pair of the uprights, a pair of intersecting cables extending diagonally from the upper ends of the uprights to add rigidity to the framework and to support a pole, the improvement comprising:

a) an inflatable canopy detachably attached to the uprights, said canopy including an interior membrane and an exterior membrane defining an envelope and a skirt;

b) a strap secured to each upright of the plurality of uprights and engaging said skirt to secure said skirt to the framework;

c) a ring disposed in said interior membrane for engaging the pole at one location to support said interior membrane;

d) a further ring disposed in said exterior membrane for engaging the pole at another location displaced from said one location; and e) an air pump for pumping air into said envelope to inflate said envelope.

12. The booth as set forth in claim 11 including an access port disposed in said interior membrane for providing access to the interior of said envelope.

13. The booth as set forth in claim 11 including a tube extending from said interior membrane and an exhaust port extending from said air pump for engagement with said tube to convey air under pressure from said air pump into said envelope.

14. The booth as set forth in claim 13 including a platform mounted on the framework for supporting said air pump.

15. The booth as set forth in claim 14 wherein said platform is supported by a pair of the rods.

16. The booth as set forth in claim 11 wherein said one location is defined by the end of a first diameter of said pole and said other location is defined by the end of a second diameter of said pole, said first diameter being greater than said second diameter.

* * * * *